US007165485B2

(12) United States Patent
Smeets et al.

(10) Patent No.: US 7,165,485 B2
(45) Date of Patent: Jan. 23, 2007

(54) ENDLESS ROPE

(75) Inventors: Paulus Johannes Hyacinthus Marie Smeets, Geulle (NL); Christiaan Henri Peter Dirks, Dilsen (BE)

(73) Assignee: DSM Ippassets B.V., Te Heerlen (NL)

( * ) Notice: Subject to any disclaimer, the term of this patent is extended or adjusted under 35 U.S.C. 154(b) by 0 days.

(21) Appl. No.: 10/516,077

(22) PCT Filed: May 27, 2003

(86) PCT No.: PCT/NL03/00396

§ 371 (c)(1),
(2), (4) Date: Jun. 13, 2005

(87) PCT Pub. No.: WO03/102295

PCT Pub. Date: Dec. 11, 2003

(65) Prior Publication Data

US 2005/0229770 A1 Oct. 20, 2005

Related U.S. Application Data

(60) Provisional application No. 60/427,188, filed on Nov. 19, 2002, provisional application No. 60/445,798, filed on Feb. 10, 2003.

(30) Foreign Application Priority Data

May 31, 2002 (NL) ..... 1020732
Nov. 1, 2002 (EP) ..... 02079571

(51) Int. Cl.
*D04C 1/00* (2006.01)
*D02G 3/22* (2006.01)

(52) U.S. Cl. ..... 87/8; 57/237

(58) Field of Classification Search ..... 57/236, 57/237; 87/6, 8, 13
See application file for complete search history.

(56) References Cited

U.S. PATENT DOCUMENTS

| | | | | |
|---|---|---|---|---|
| 2,181,344 | A | 11/1939 | Rick | |
| 2,281,036 | A | 4/1942 | Hetzel | |
| 2,600,395 | A | 6/1952 | Domoj | |
| 4,170,921 | A | 10/1979 | Repass | |
| 5,901,632 | A * | 5/1999 | Ryan | 87/13 |

* cited by examiner

*Primary Examiner*—Shaun R. Hurley
(74) *Attorney, Agent, or Firm*—Nixon & Vanderhye, P.C.

(57) ABSTRACT

Endless rope containing primary strands, the primary strands containing laid-up secondary strands, the laid-up secondary strands containing rope yarns, wherein the primary strands have been laid up from 3, 4 or 6 secondary strands, wherein the rope contains a splice in at least every primary strand and wherein the rope preferably has been laid up from 3, 4 or (1+6) primary strands or, alternatively, has been braided from 8 or 12 primary strands.

6 Claims, 1 Drawing Sheet

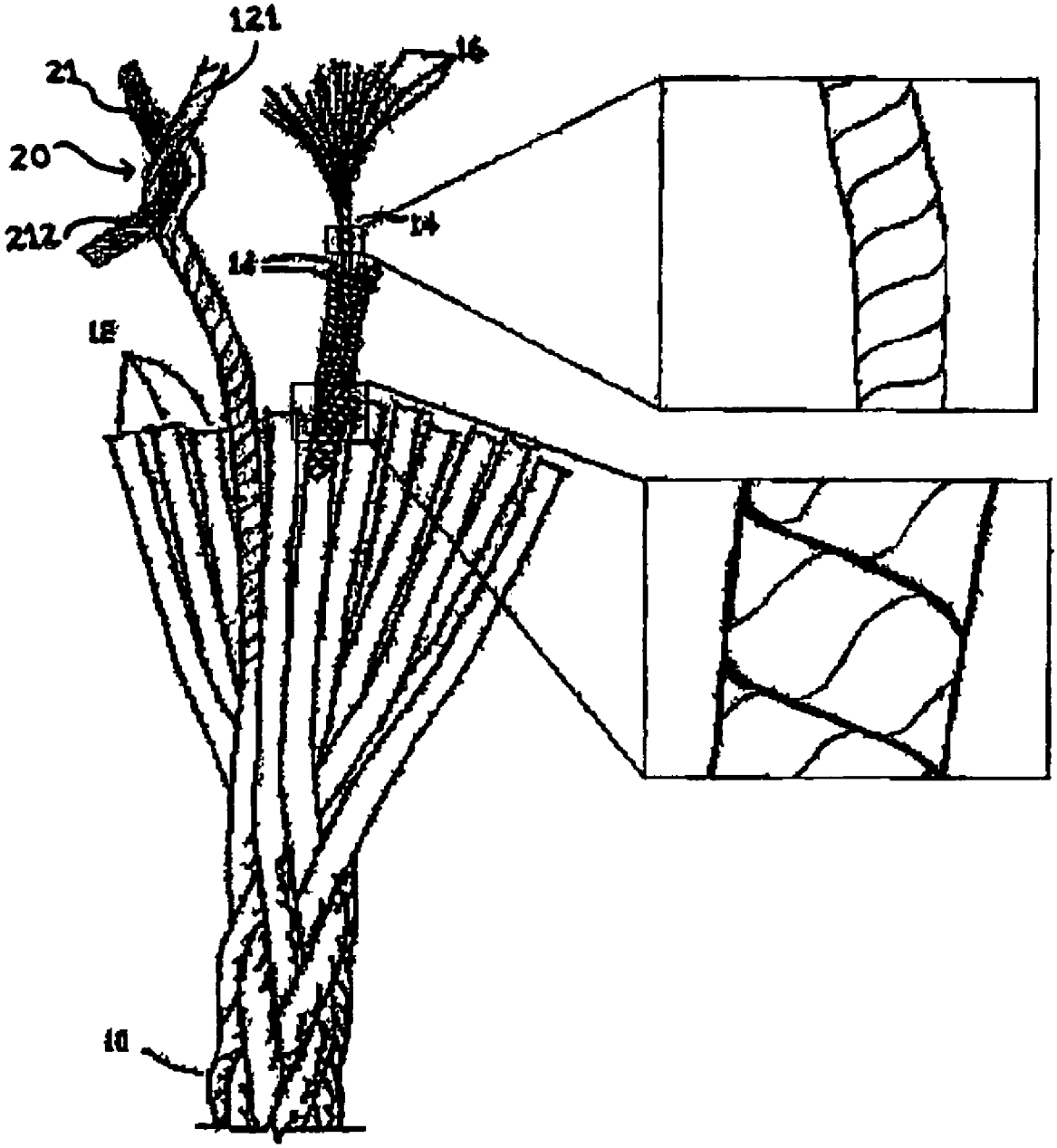
121
21
16
20
212
14
14
12
10

ENDLESS ROPE

CROSS REFERENCE TO RELATED APPLICATION

This application is the National Phase of International Application PCT/NL03/0396 filed May 27, 2003 which designated the U.S., and was published in English. This application further claims benefit of priority of U.S. provisional application Ser. No. 60/427,188, filed Nov. 19, 2002 and Ser. No. 60/445,798, filed Feb. 10, 2003, both of which are herby incorporated by reference in their entirety.

BACKGROUND OF THE INVENTION

The invention relates to an endless rope containing primary strands, the primary strands containing laid-up secondary strands, the laid-up secondary strands containing rope yarns.

A rope construction for the manufacture of an endless rope is known from U.S. Pat. No. 5,901,632, which describes a braided rope consisting of braided primary strands, which in their turn consist of rope yarns. From this an endless rope can be manufactured by making a splice in the braided primary strand when during the manufacture of the rope a reel of a braided primary strand gets empty.

A rope containing primary strands, the primary strands containing secondary strands, the secondary strands containing rope yarns, is also known from U.S. Pat. No. 4,170,921. This document discloses a double braided rope consisting of a braided core and a braided cover, the core or the cover rope containing primary strands, which consist of several secondary strands, which in their turn are made up of twined rope yarns, wherein the primary strands have been made by bundling together in substantially parallel position several secondary strands. Such ropes can in general be manufactured rapidly.

The drawback of such a rope, however, is that it cannot be used for the manufacture of endless rope. When in the manufacture of such a rope a reel with primary strand runs empty, there is no possibility to connect the primary strand to that of a following reel without considerable loss of strength.

The aim of the invention is to provide an endless rope.

SUMMARY OF THE INVENTION

It has been found to be possible to achieve this aim when in the rope according to the invention the primary strands are laid up from 3, 4 or 6 secondary strands yarns and the rope contains a splice in at least every primary strand.

An advantage of the rope according to the invention in comparison with the rope of U.S. Pat. No. 5,901,632 is that the rope according to the invention can be manufactured faster, has a higher strength and is easier to splice.

Due to this it is achieved that an endless rope can be manufactured as will be further described below.

DETAILED DESCRIPTION AND PREFERRED EMBODIMENTS

A rope which has been built up in several steps contains several construction elements. Examples of this are a yarn composed of twined or non-twined filaments, or a strand or a combination thereof, which can be composed of laid-up or braided yarns or thinner strands.

In the rope according to the invention the primary strands can be braided or laid up with each other.

If the rope has been laid up, the rope has preferably been laid up from 3, 4 or (1+6) primary strands.

If the rope has been braided, the rope has preferably been braided from 8 or 12 primary strands.

In the rope according to the invention the primary strands have been laid up from 3, 4 or 6 secondary strands.

In general the secondary strands, depending on the size of the rope ultimately to be obtained, contain several twined rope yarns which can have been divided over several layers in these strands.

The rope yarns in the rope according to the invention contain several fibres. The fibres in the rope yarn can be smooth or twined.

If successive construction elements both contain a twist, the twist directions are preferably opposite in successive construction elements.

An advantage of the rope according to the invention is the fact that if during the use of the rope some strands get damaged, they can be renewed without the need to take off the entire rope. Also, the rope according to the invention has a better wear resistance than known ropes.

A problem involved in the manufacture of an endless rope is that there are limits to the diameter of the reels carrying the primary strands, so that the wound-up length of the primary strands is finite and the reels will get empty during the production of rope. For the manufacture of an endless rope now, the tail end of a first strand on a reel that gets empty has to be connected to the lead end of a second strand on a new reel.

This can be done simply now with the rope of the invention by splicing the tail end of the first strand to the lead end of the second strand with application of a standard splicing technique. By making such splices at successive spots in each of the primary strands an endless rope can be manufactured without significant loss of strength of the rope.

Ropes with a diameter of 20 mm or more are mostly produced from strands the yarns of which are built up in several layers. A strand is in general composed of a core, consisting for instance of 3 rope yarns, with around it several layers consisting of multiple rope yarns. In such a strand no splice can be made. The length of such a rope is therefore limited by the volume of the braiding bobbins on a braiding machine for braided rope or by the volume of the reels on a rope-laying machine for a laid-up rope.

An extra advantage of the rope according to the invention is that its thickness does not involve any restriction of its length, because a splice can be made herein. The invention therefore preferably relates to an endless rope having a diameter of more than 20 mm. The length of the endless rope is more than 250 meters, preferably more than 1000 meters.

BRIEF DESCRIPTION OF THE DRAWING

The FIGURE shows one of the embodiments of the rope according to the invention, being a 12-strand braided rope (10), which consists of 4-strand laid-up primary strands (12) with an S-twist. The primary strands consist of secondary strands (14) which have been laid up from rope yarns (16) in a Z-twist. Normally, half of the strands consist of an S-twist and the other half of a Z-twist. For additional clarity, a portion of a secondary strand (14) is shown in an expanded view and, similarly, a portion of a laid-up primary strand (12) formed from twisted secondary strands is also shown in an expanded view.

For the manufacture of such a rope, rope yarns (16) can be twined from a bundle of fibres with the help of a standard twining machine. A secondary strand (14) is then laid up from several rope yarns on a strand bench, with the direction of twist being opposite to the direction of twist in the rope yarn. Four of those strands are laid up to form the primary strand (12). Then 12 primary strands are braided to form the rope (10). This is done on a braiding machine with 12 reels which are filled with primary strands. An endless rope can be made now by, when one of the reels gets empty, connecting the tail end (121) of a first primary strand on the empty reel to the lead end (212) of a second primary strand (21) on a full reel and replacing the empty reel by the full reel. Eventually, at least every primary strand in rope (10) will be connected, e.g., by splicing, to a new primary strand. Connecting two strand ends can be done by applying a splice (20) in accordance with a known method as described for instance in The Splicing Handbook, "Techniques for Modern and Traditional Ropes", by Barbara Merry with John Darwin, ISBN 0-87742-952-9.

Another, more preferable method is a method wherein:

a) one end of a first primary strand end is split in a first and a second part comprising respectively a first and a second number of secondary strands, the first part having at most one more secondary strands than the second part
b) the first part is tucked from one side in an opening in the second primary strand, such that the opening has a first number secondary of strands on one side and a second number of secondary strands on the other side, where the first and second number differ at most by one,
c) the second part is tucked from the other side in the opening in the second primary strand step b) and c) are repeated at least 3, respectively 3+1 times, whereby the respective openings in the second primary strand end are separated such that the first and the second part have crossed over at least all the secondary strands of the second primary strand once and the first and second part leave the second primary strand at respective last openings.

In this method one end of a first primary strand is split in a first and a second part comprising respectively a first and a second number of secondary strands, the first part having at most one more strands than the second part. This means that a 3-strand primary strand is split in a first part with 2 secondary strands and a second part with only 1 secondary strand. A 4-strand primary strand is split in two parts of 2 secondary strands and a 6-strand primary strand in two parts of 3 strands.

When the first and second primary strand have 3 strands each, the said opening has 2 strands on one side and 1 strand on the other side. When the first and second rope has 4 or 6 strands the said opening has 2, respectively 3 strands on both sides.

The second part is tucked from the other side in the opening in the second primary strand, which implies that both parts of the first primary strand are tucked in different directions through the opening in the second primary strand.

Step b) and c) are repeated at least 3 times, whereby the respective openings are separated such that the first and the second part have crossed over at least all the secondary strands of the second primary strand once and the first and second part leave the second primary strand at respective last openings. The sequence wherein step b) and c) are repeated is of no importance for the efficiency of the resulting splice.

An advantage of this splice is, that with this method a splice is much faster to produce.

The ropes can be made from different yarns. Suitable yarns are polyester, nylon, polyethylene, polypropylene, aramide, polybenzoxazole (PBO) and "High Modulus Poly-Ethylene (HMPE) as Dyneema® or Spectra®.

The endless rope according to the invention preferably contains HMPE yarns.

The invention will be further elucidated by means of the following non-restrictive example and comparative example in which the primary strands have been laid up and braided, respectively.

EXAMPLE I

Rope (1) has been built up from laid-up strands (3×1(8/1760 dTex Dyneema SK-75), with a lay-up length of 34 mm and a weight of 4.27 g/m,). The breaking strength of such a strand is 10797 N.

On a Ratera braider these strands were made into a 12-strand braided rope with a braid length of 8× the diameter. The weight of the rope was 54.6 g/m. The rope had a breaking strength of 77820 N.

Comparative Experiment A

Rope (2) has been built up from braided strands (8×1(3/1760 dTex Dyneema SK-75), with 12 picks per 10 cm and a weight of 4.37 g/m. The breaking strength of such a strand is 9670 N.

On a Ratera braider these strands were made into a 12-strand braided rope with a braid length of 8× the diameter. The weight of the rope was 56 g/m. The rope had a breaking strength of 61740 N.

From this it appears that the strand strength of the laid-up construction is about 15% higher than that of the braided construction.

Although the strand strength of the laid-up construction is only 15% higher than that of the braided construction, the strength of the rope made of it surprisingly is 26% higher than the strength of the rope made from the braided construction. Further, the construction stretch of the braid with the braided strands is significantly higher than in the case of the laid-up strand.

EXAMPLE II

In the rope (1) a standard splice is made as described in The Splicing Handbook, "Techniques for Modern and Traditional Ropes", by Barbara Merry with John Darwin, ISBN 0-87742-952-9.

The splice was impregnated with a coating (LAGO 50, from GOVI, Belgium), which made it possible to use a much shorter splice length than for a non-coated splice in a Dyneema rope.

In rope (1) two types of end connection were tested:

i) splicing together two strand ends to be connected, with a total of 24 tucks, the last 3 of which were thinned. The breaking strength of a rope with such a splice amounted to 67990 N. When the number of tucks is 27 and the last 3 are thinned, the breaking strength amounts to 81660 N.
ii) making two loops hooking into each other by splicing back into each other the two strand ends, with 16 tucks. This has a breaking strength of 70550 N.

This shows that a spliced-in connection does not cause a loss of strength for the spliced-up strands if this is done optimally, i.e. if a sufficient number of tucks is made.

However, if loops are used to make the connection, this results in loss of breaking strength and this connection disturbs the structure of the 12-strand production braid which is unacceptable in view of the use of the braid.

The invention claimed is:

1. Endless rope containing primary strands, the primary strands containing laid-up secondary strands, the laid-up secondary strands containing rope yarns, wherein the primary strands have been laid up from 3, 4 or 6 secondary strands and the rope contains a splice in at least every primary strand.

2. Endless rope according to claim 1, wherein the rope has been laid up from 3, 4 or (1+6) primary strands.

3. Endless rope according to claim 1, wherein the rope has been braided from 8 or 12 primary strands.

4. Endless rope according to claim 1, wherein the rope contains HMPE yarns.

5. Endless rope according to claim 1, wherein the diameter of the rope is more than 20 mm.

6. Endless rope according to claim 5, wherein the length of the rope is more than 1000 meters.

* * * * *

UNITED STATES PATENT AND TRADEMARK OFFICE

CERTIFICATE OF CORRECTION

PATENT NO. : 7,165,485 B2
APPLICATION NO. : 10/516077
DATED : January 23, 2007
INVENTOR(S) : Smeets et al.

It is certified that error appears in the above-identified patent and that said Letters Patent is hereby corrected as shown below:

Face Page, left column,

Correct the Spelling of Item (73) to read

--[73] Assignee: DSM IP Assets B.V., Te Heerlen (NL)--

Signed and Sealed this

Eighth Day of May, 2007

JON W. DUDAS
*Director of the United States Patent and Trademark Office*